US012590777B2

(12) United States Patent
Langley et al.

(10) Patent No.: US 12,590,777 B2
(45) Date of Patent: Mar. 31, 2026

(54) LEVER SYSTEM FOR LEVER BOW

(71) Applicant: Bear Archery, Inc., Evansville, IN (US)

(72) Inventors: Timothy Langley, McDaniels, KY (US); David Hahn, Elberfeld, IN (US)

(73) Assignee: Bear Archery, Inc., Evansville, IN (US)

( * ) Notice: Subject to any disclaimer, the term of this patent is extended or adjusted under 35 U.S.C. 154(b) by 156 days.

(21) Appl. No.: 18/470,479

(22) Filed: Sep. 20, 2023

(65) Prior Publication Data

US 2025/0093124 A1 Mar. 20, 2025

(51) Int. Cl.
*F41B 5/10* (2006.01)

(52) U.S. Cl.
CPC ..... *F41B 5/105* (2013.01)

(58) Field of Classification Search
CPC ..... F41B 5/105; F41B 5/10; F41B 5/123
USPC ..... 124/25.6
See application file for complete search history.

(56) References Cited

U.S. PATENT DOCUMENTS 4,041,927 A 8/1977 Van House
4,192,280 A * 3/1980 Rickard ..... F41B 5/10 124/900
4,512,326 A * 4/1985 Jarrett ..... F41B 5/10 124/900
5,388,564 A * 2/1995 Islas ..... F41B 5/10 124/900
5,499,618 A * 3/1996 Thompson ..... F41B 5/0094 124/88
5,979,425 A * 11/1999 Loomis ..... F41B 5/10 124/25.6
6,067,974 A * 5/2000 Islas ..... F41B 5/0094 124/900
7,201,161 B1 * 4/2007 York ..... F41B 5/0094 124/16
9,121,658 B1 * 9/2015 Darlington ..... F41B 5/123
10,145,642 B1 * 12/2018 Darlington ..... F41B 5/123
2013/0074819 A1 * 3/2013 McPherson ..... F41B 5/105 124/25.6
2016/0033227 A1 * 2/2016 Liu ..... F41B 5/10 124/25.6

(Continued)

FOREIGN PATENT DOCUMENTS

GB 2286133 * 8/1995 ..... F41B 5/10

OTHER PUBLICATIONS https://www.feradyne.com/product/vxm-bowfishing-bow/ [online], accessed Jun. 6, 2023, 4 pages.

(Continued)

*Primary Examiner* — John E Simms, Jr.
(74) *Attorney, Agent, or Firm* — Woodard, Emhardt, Henry, Reeves & Wagner, LLP

(57) ABSTRACT

An archery bow is disclosed. Bows of the present disclosure comprise lever cams. The lever cam includes a base and an elongated lever arm that extends upwards or downwards, depending on which end of the bow the lever cam is attached to. The lever cams are rotatably secured between the split limbs of the bow. In some embodiments, the bows include an adjustment screw to change the position of an offset axle relative to a lever axle. In other embodiments, the bows include a pair of adjustable bowstring modules attachable to the respective elongated lever arms to alter the draw length of the bowstring.

12 Claims, 20 Drawing Sheets

(56) References Cited

U.S. PATENT DOCUMENTS

2016/0195353 A1* 7/2016 Hyde ..... F41B 5/10
29/402.04

OTHER PUBLICATIONS https://www.feradyne.com/product/lvx-bow/, [online] accessed Jun. 6, 2023, 3 pages.

* cited by examiner

LEVER SYSTEM FOR LEVER BOW

FIELD OF THE DISCLOSURE

The present disclosure relates generally to archery bows and more particularly to compound lever bows.

BACKGROUND OF THE DISCLOSURE

There are a variety of bow types that an archer may choose from. For example, there are straight-limbed bows, recurve bows, compound bows, and lever bows. Straight-limbed bows typically have limbs that point straight up and down, which rely heavily on the action of the draw and release of the bowstring to propel the arrow. Recurve bows were developed to provide more energy to propel the arrow. Specifically, the limbs of a recurve bow curve away from the archer before a bowstring is attached to the limbs. When the bowstring is attached, the limbs are bent towards the archer, thus storing additional energy and providing more speed to the arrow. When the bowstring is drawn and released, the stored energy in the flexed limbs propels the arrow more efficiently compared to a straight-limbed bow.

In modern archery, compound bows and lever bows have been developed to achieve similar advantages; namely, more powerful shots and quicker arrow speed. Compound bows typically implement a levering system of cables and cams or pulleys configured to flex and bend the limbs of the bow to provide the energy to propel the arrow. The mechanical advantage of the compound bow allows for more rigid limbs, making the limbs more energy-efficient than previous bows. Specifically, as the limbs are more rigid, the bow experiences less energy dissipation due to limb movement during firing of the bow. This allows the energy stored to be focused into the bowstring and arrow. The shape of the cams used with compound bows also create let-off, where the force required to pull and/or hold the bowstring at full draw may be roughly 70-85% easier than required during draw. This allows archers to concentrate on aiming the bow.

Lever bows, as illustrated in FIG. 1, are another type of bow that modern archers may prefer. Advantageously, the draw of a lever bow is typically smoother than the compound bow counterpart. Lever bows traditionally utilize a secondary set of limbs attached to the ends of the upper and lower bow limbs configured to provide additional flex and power. The secondary limbs act as a "recurve" bow limb, in that the limbs typically curve away from the archer before the bowstring is attached during assembly. The secondary limbs are attached to the end of the upper and lower bow limbs, respectively, and are configured to pivot relative to the bow limbs. They are further connected to the opposing side of the bow by a set of y-cables or power cables. As the bowstring is drawn, the secondary limbs pivot and flex, thus flexing the bow limbs, providing energy for the arrow.

Compound bows and lever bows each offer advantages and disadvantages. Thus, there is a need for improvements.

SUMMARY OF THE DISCLOSURE

It is an object of the present disclosure to provide a bow that includes the advantages of both compound bows and lever bows, while minimizing disadvantages. Embodiments of the present disclosure include lever cam arrangements for archery bows as a hybrid combination of lever bows and compound bows. The lever cams are rotatably secured between split-limbs of a bow. The lever cams of the present disclosure include a base. The base includes a lever axle located on the rearward end of the lever cam (i.e., towards the archer). The lever axle is a pivot point that pivotably couples the lever cam between split limbs of the bow. The forward end of the base includes an anchor securing one end of a power cable thereto. In some embodiments, the forward end of the base further includes a power cable groove align a portion of the power cable.

The base further includes an elongated lever arm that extends upwards or downwards depending on which end of the bow the lever cam is affixed to. The elongated lever arm includes a bowstring anchor. The bowstring anchor secures one end of the bowstring to the lever cam. In some embodiments, the elongated lever arm includes a bowstring groove to align a portion of the bowstring. In some embodiments, the lever cam arrangements include an offset axle. The offset axles includes opposing ends that include anchor points to secure a y-yoke end of a power cable extending from the opposing lever cam.

It is a further object of the present invention to provide adjustment mechanisms to easily alter the draw length of the bows described herein. In some embodiments, the lever cams include an adjustment screw inserted and/or secured within the offset axle of the lever cam. In certain embodiments, the adjustment screw is a worm gear. By loosening and/or tightening the adjustment screw, the position of the offset axle is rotated relative to the lever axle, which acts as a pivot point. As the offset axle is secured through the lever cam, the lever cam also rotates relative to the lever axle. As the lever cam rotates, the draw length of the bow is altered by moving the bowstring closer to or further from its full draw position.

In other embodiments, an adjustable bowstring module is attached to the elongated lever arm of each lever cam. The bowstring module alters the routing of the bowstring by effectively altering the width and/or height of the elongated lever arm. By routing the bowstring over a greater distance, by the increased width and/or height, the bowstring module alters the draw length. The more distance that the bowstring module routes the bowstring, the shorter the draw length of the bow. The elongated lever arms further include a plurality of bores to secure the bowstring module to the elongated lever arm. By selectively attaching the bowstring module to specific bores, the amount of routing can be selected, allowing an archer to specify a particular draw length.

Further forms, objects, features, aspects, benefits, advantages, and embodiments of the present disclosure will become apparent from a detailed description and drawings provided herewith.

DETAILED DESCRIPTION OF THE DISCLOSURE

Figure 1:
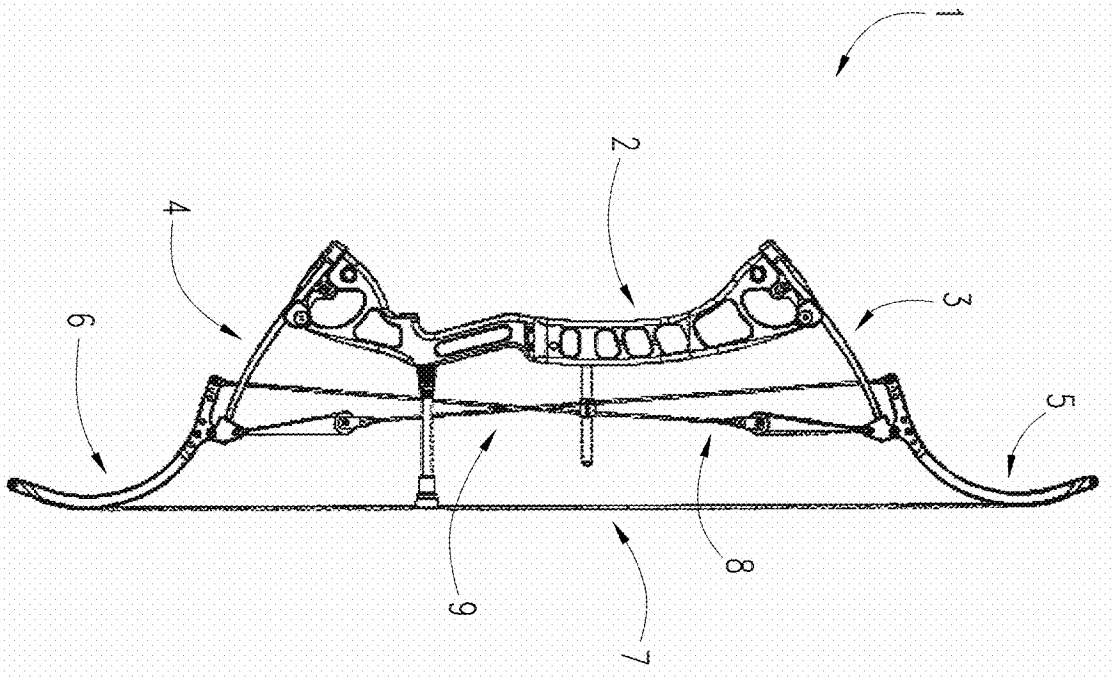
Fig. 1 (Prior Art)
FIG. 1 is a perspective view of a prior art lever bow.

For the purpose of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates. One embodiment of the disclosure is shown in great detail, although it will be apparent to those skilled in the relevant art that some features that are not relevant to the present disclosure may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Embodiments of the present disclosure include lever cam arrangements for archery bows. The lever cams are rotatably secured between split-limbs of a bow. The lever cams of the present disclosure include a base. The base is on a lever axle located toward the rearward end of the lever cam (i.e., towards the archer). The lever axle is a pivot point that pivotably couples the lever cam between split limbs of the bow. The forward end of the base includes an anchor to secure one end of a power cable thereto. In some embodiments, the forward end of the base further includes a groove to align a portion of the power cable.

The base further includes an elongated lever arm that extends upward or downward depending on which end of the bow the lever cam is affixed to. The elongated lever arm includes a bowstring anchor. The bowstring anchor secures one end of the bowstring to the lever cam. In some embodiments, the elongated lever arm includes a bowstring groove to align a portion of the bowstring. In some embodiments, the lever cam arrangements include an offset axle. The offset axles includes opposing ends that include anchor points to secure a y-yoke end of a power cable thereto.

It is a further object of the present invention to provide adjustment mechanisms to easily alter the draw length of the bows described herein. In some embodiments, the lever cams include an adjustment screw inserted and/or secured within the offset axle of the lever cam. In certain embodiments, the adjustment screw is a worm gear. By loosening and/or tightening the adjustment screw, the position of the offset axle is rotated relative to the lever axle. As the offset axle is adjusted, the draw length of the bow is altered.

In other embodiments, an adjustable bowstring module is attached to the elongated lever arm of the lever cams. The bowstring module alters the routing of the bowstring by effectively altering the width and/or height of the elongated lever arm. By routing the bowstring over a greater distance, by the increased width and/or height, the bowstring module alters the draw length. The more distance that the bowstring module routes the bowstring, the shorter the draw length of the bow. The elongated lever arms further include a plurality or series of bores secure the bowstring module to the elongated lever arm. By selectively attaching the bowstring module to specific bores, the amount of routing can be selected, allowing an archer to specify a particular draw length.

FIG. 1 is a side view of a prior art lever bow 1. The lever bow includes a riser 2 with inner limbs 3, 4 attached at opposing ends of riser 2. Pivotally attached to the end of limbs 3,4 are outer limbs 5, 6 that are attached to their respective inner limbs by hinges. Specifically, the terminal or rearward end of inner limbs 3, 4 include hinges to attach outer limbs 5, 6 thereto. The inner hinges are coupled to the outer limbs 5, 6 at or near the forward end of the outer limbs 5, 6. The bow 1 includes a bowstring 7 attached to the ends of the outer limbs 5, 6. Further, the outer limbs 5, 6 are connected to an end of the opposing inner limb by power cables 7, 8. As bowstring 7 is drawn, outer limbs 5, 6 are pulled rearward towards the archer and pivot relative to the inner limbs 3, 4. This movement flexes both the inner and outer limbs and during release, the outer limbs 5, 6 and the inner limbs 3, 4 provide the energy to shoot the arrow. Additionally, during release, the power cables 8, 9 assist outer limbs 5, 6 to pivot forward relative to the hinges and inner limbs 3, 4.

Figure 2:
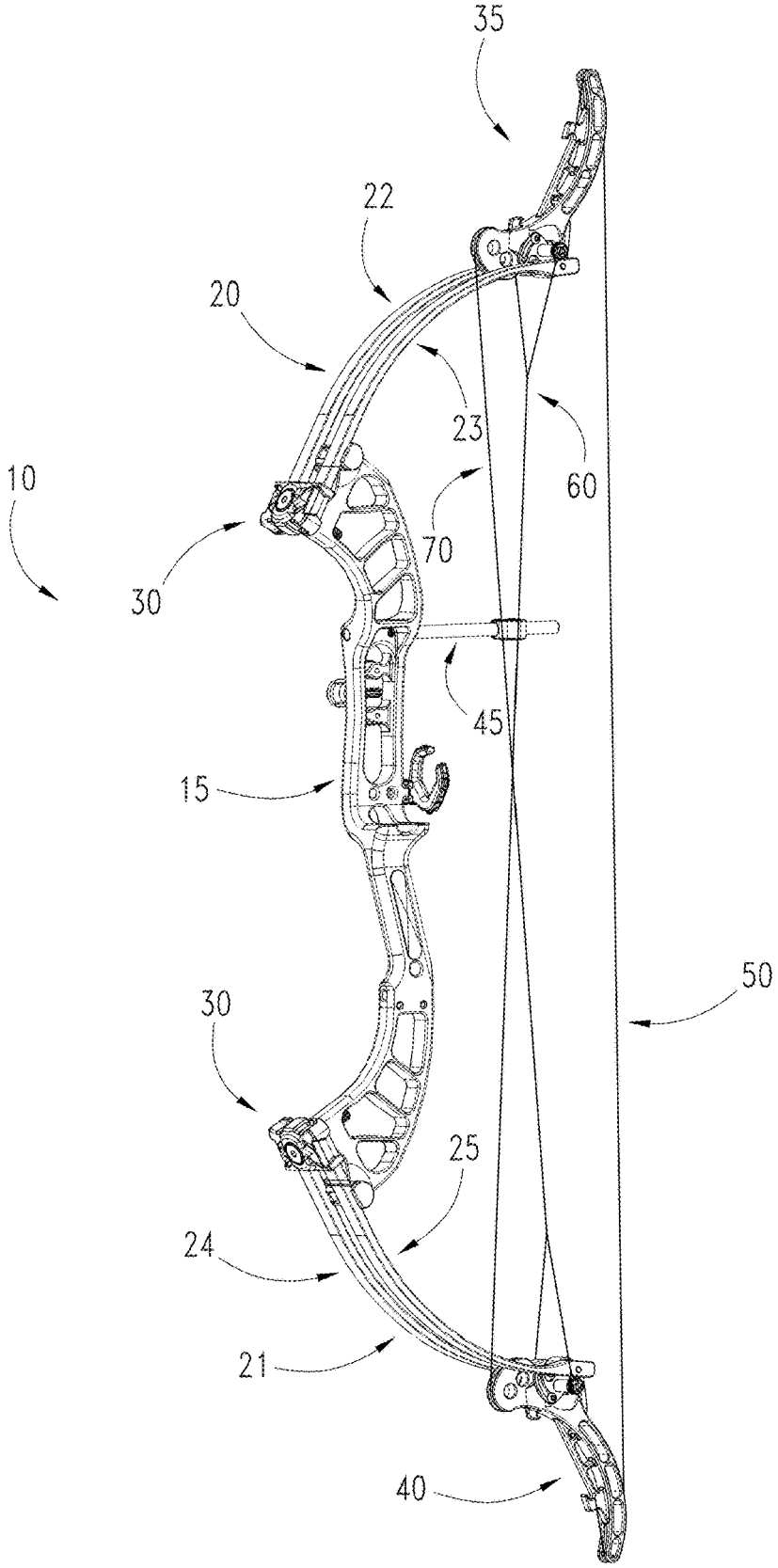
FIG. 2 is a side view of an embodiment of a compound lever bow of the present disclosure.

FIG. 2 depicts a representative embodiment of an archery bow 10 of the present disclosure. The bow 10 includes a handle or riser 15. The riser 15 is configured as a grasping point for a user of the bow and further includes an arrow rest or arrow rest mount configured for placing and knocking an arrow. An upper limb 20 and a lower limb 21 are attached at opposing ends of the riser 15. The bow illustrated in FIG. 1 is a "quad-bow". As such, the upper limb 20 includes an upper left limb 22 and an upper right limb 23. Correspondingly, the lower limb 21 includes a lower right limb 24 and a lower left limb 25. The upper limb 20 is attached to the upper portion of the riser via limb pocket 30. Similarly, the lower limb 21 is attached to the lower portion of the riser via limb pocket 30. At the ends of the upper limb 20 and the lower limb 21 are an upper lever cam assembly 35 and a lower lever cam assembly 40, respectively. The upper lever cam assembly 35 is pivotally secured between the upper left limb 22 and upper right limb 23 of the upper limb 20, while the lower lever cam assembly 40 is pivotally secured between the upper right limb 24 and the upper left limb 25 of the lower limb 21.

As shown, the bowstring 50 extends between and is secured to both the upper lever cam assembly 35 and the lower lever cam assembly 40. Similarly, the y-cables/power cables 60, 70, extend between and are secured to both lever cam assemblies 35, 40. In some embodiments, the bow 10 includes a cable guide 45 mounted on a support arm extending from the riser 15. The cable guide 45 guides the power cables between upper lever cam assembly 35 and lower lever cam assembly 40. In some embodiments, the power cables create an "x" pattern by crossing at the cable guide 45. Specifics of the bowstring and power cables are discussed in further detail below.

In this embodiment, the upper limb 20 and the lower limb 21 are made of a resilient material and are flexed during assembly of bow 10 (i.e., attachment of cables to the bow). As one example, the limbs 20, 21 are made of carbon fiber. The upper left 22, upper right 23, lower right 24, and lower left 25 limbs, in this embodiment, have a rectangular cross-sectional shape (see FIG. 5). During use of bow 10, when the bowstring 50 is drawn, the upper limb 20 and lower limb 21 flex to store energy. Once the bowstring is released, the stored-up energy from the flexed limbs 20, 21 propels the arrow towards its target. In this embodiment, the upper lever cam assembly 35 and lower lever cam assembly 40 rotate relative to the upper limb 20 and lower limb 21, respectively, when the bowstring 50 is drawn. This combination of the flex of the limbs 20, 21 and the rotation of the upper lever cam assembly 35 and lower lever cam assembly 40, along with the initial tension placed on the power cables defines the draw force curve of the bow 10. Part of the draw force curve is the draw length, or the amount of distance the bowstring must be moved to reach a full-draw position. The upper lever cam assembly 35 and lower lever cam assembly 40 of this embodiment include adjustment mechanisms to alter the draw length of the bow, and therefore alter the draw force curve, without the need for new parts, rebuilds, etc. This will be discussed in more detail below.

Figure 3:
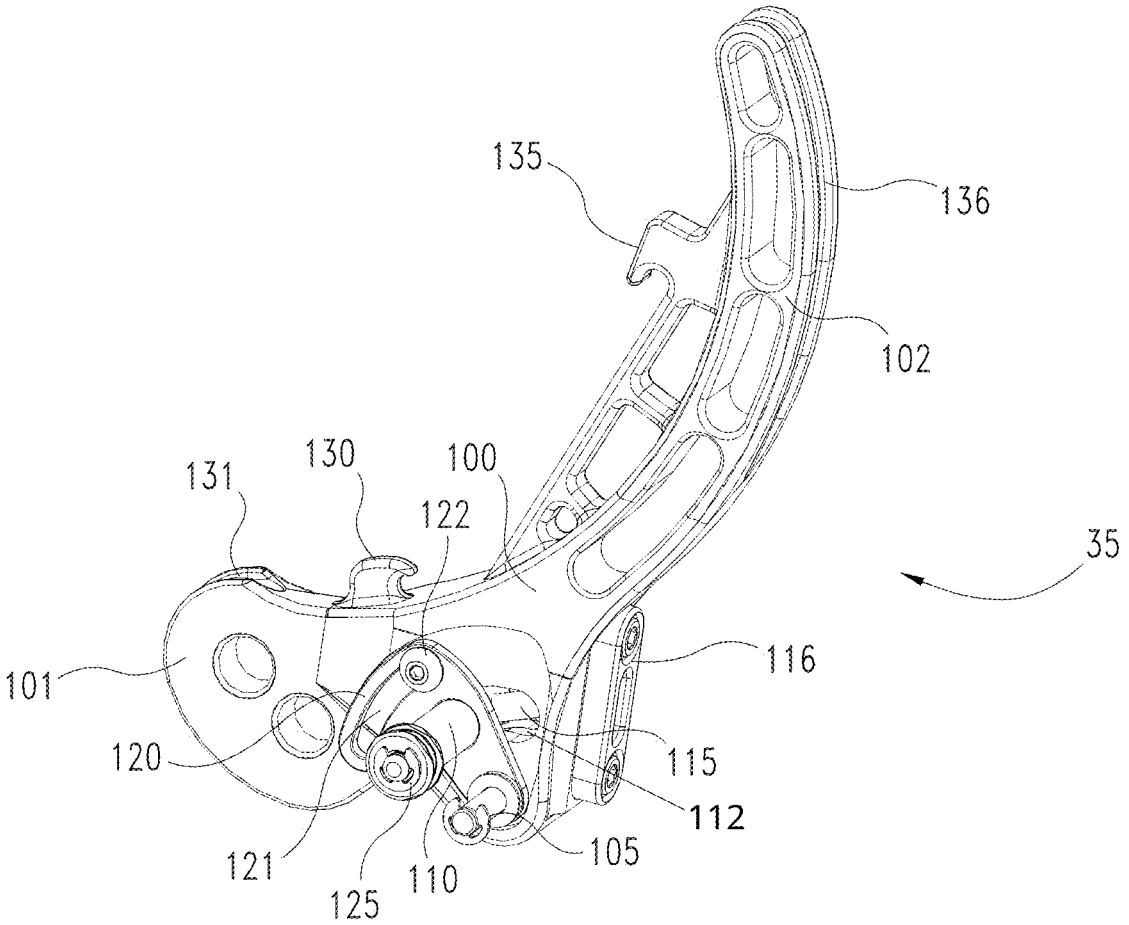
FIG. 3 is side perspective view of one embodiment of a lever assembly of the present disclosure.
Figure 4:
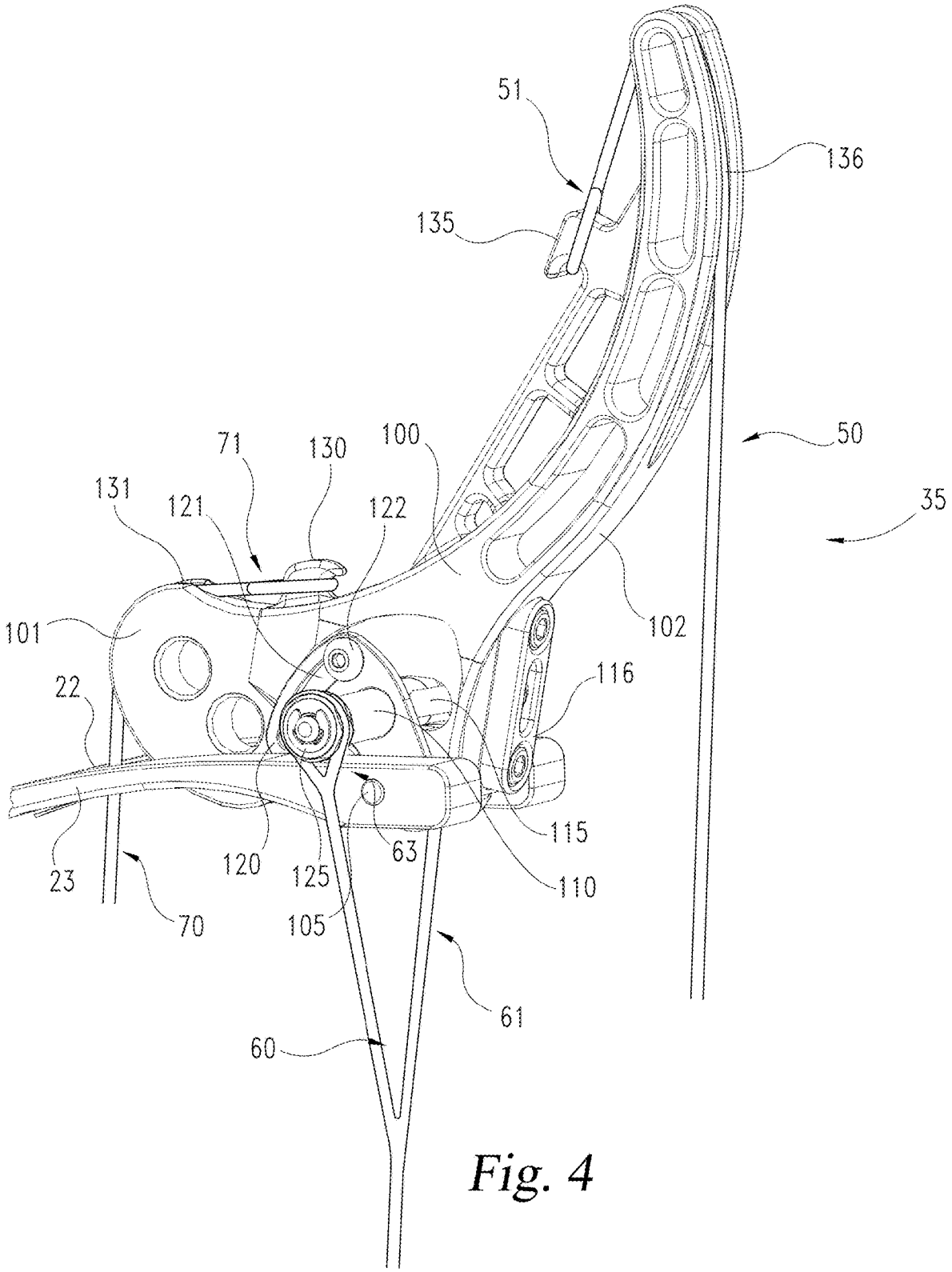
FIG. 4 is a side perspective view of the upper limb lever assembly of the bow shown in FIG. 2.
Figure 5:
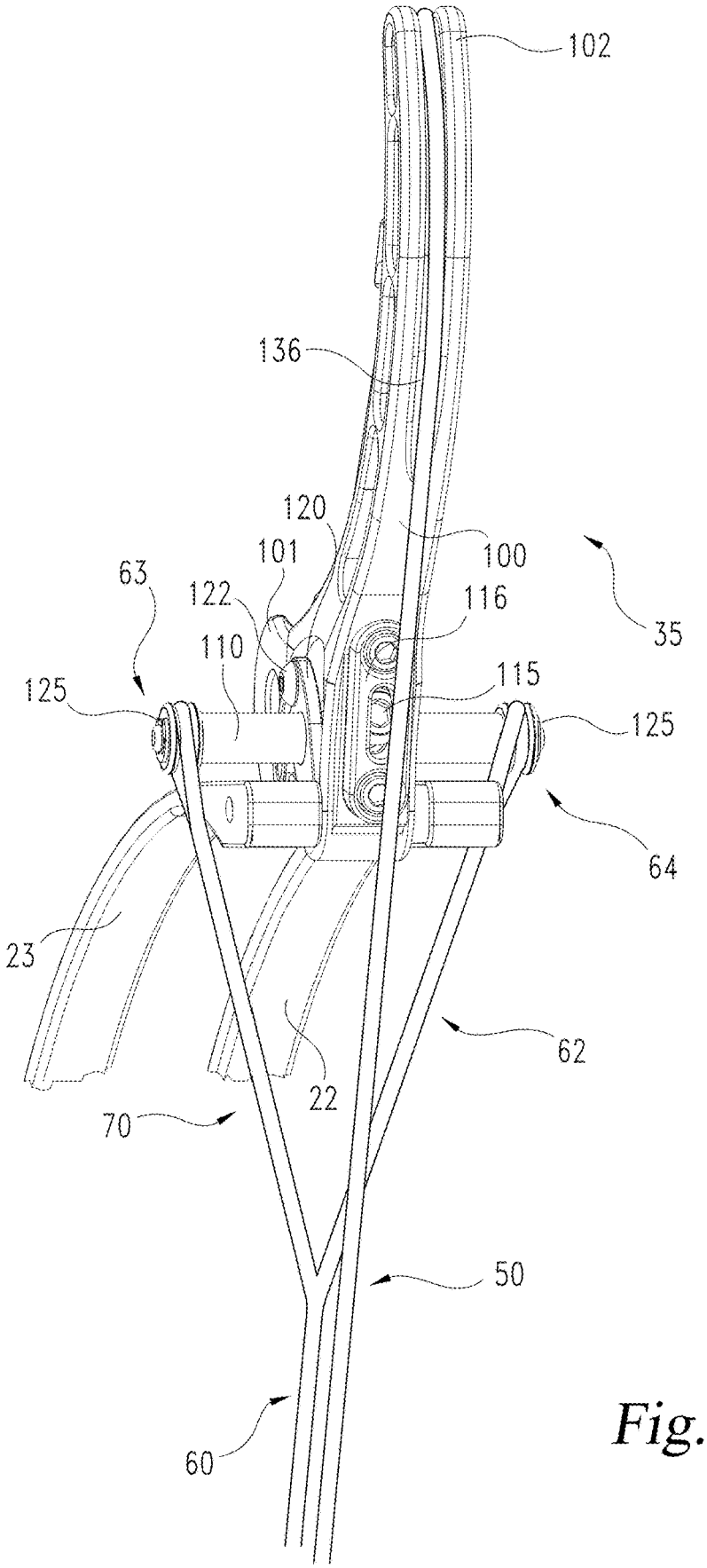
FIG. 5 is a rear perspective view of the upper limb lever assembly of FIG. 4.

FIGS. 3, 4, and 5 illustrate various views of the upper lever cam assembly 35. The upper lever cam assembly 35 comprises a lever cam 100, which includes a base 101 and an upper elongated lever arm 102. In the upper lever cam 100, the elongated lever arm 102 extends upward from the base 101. The upper elongated lever arm 102 includes a rearward side (i.e., towards to archer) and a forward side (i.e., towards the riser 15). The lever cam 100 acts as a bell-crank or L-shaped lever arm, which will be discussed in more detail below. The upper lever cam assembly 35 further includes lever axle 105, which pivotally couples the lever cam 100 between the left and right upper limbs 22, 23. The lever cam 100 rotates about lever axle 105. In this embodiment, the lever cam assembly 35 includes offset axle portions 110 that comprise a single piece that extends through the lever cam 100. Offset axle 110 is parallel to yet spaced apart from lever axle 105. The upper offset axle portions 110 extend through a slot 112 in the upper lever cam base 101. The lever cam assembly 35 further includes an upper adjustment screw 115 coupled to offset axle 110 and secured to lever cam 100 via screw plate 116. In this embodiment, the adjustment screw 115 is a worm gear threaded perpendicularly within offset axle 110. In other embodiments, other mechanisms may be used.

In this embodiment, the lever cam assembly 35 includes two offset link arms 120 on opposing sides of base 101. Both the lever axle 105 and the offset axle 110 extend through the link arms 120. The link arms 120 are further coupled to the lever cam 100 via set screws 122. Since the link arms 120 are attached to the lever cam 100, the link arms 120 rotate with lever cam 100 both during adjustment via adjustment screw 115 and during draw and release of bow 10. The link arms 120 include guide 121. The set screw 122 moves within guide 121 as lever cam 100/link arms 120 rotate. In some embodiments, the guide 121 further defines the range of set points that lever cam 100 can be adjusted to. For example, as shown in FIG. 3, lever cam 100 is set at its maximum draw length. Said differently, adjustment screw 115 can only adjust the rotation of lever cam 100 in one direction from the configuration depicted. The adjustment screw 115 is rotatable to specific positions of rotation, where the upper lever cam 100 is rotated to a particular draw length. Said differently, rotating the adjustment screw 115 to different positions yields a different draw length of the bow 10. In some embodiments, the set screws 122 further act as a locking mechanism to secure the lever cam 100 at a desired position/draw length.

In some embodiments, the opposing ends of the offset axle 110 include power cable anchors 125. The anchors 125 anchor the y-yoke end of power cable 60. In some embodiments, the y-yoke end of the power cable is attached at other locations. For example, to limbs 22, 23 or to the lever axle 105. As the offset axle 110 is attached to the lever cam 100, as the lever cam 100 rotates relative to the lever axle during adjustment and/or use, offset axle 110 also rotates relative to the lever axle. This, in turn, causes the y-yoke end of power cable 60 to also rotate in conjunction with offset axle 110. The offset axle 110 and therefore the y-yoke end of power cable 60 thus rotate in an "arc" relative to the lever axle 105.

The base 101 also includes a power cable anchor 130. This anchor 130 secures the single end of power cable 70 to the lever cam 100. Mounting of the power cables will be discussed in more detail below. The forward end of base 101 further includes a power cable groove 131. In some embodiments, the groove 131 extends along the forward side of base 101. In other embodiments, the groove 131 only extends along a portion of the forward side of base 101. Once attached to the upper lever cam assembly, a portion of power cable 70 is aligned within the power cable groove 131 as it extends towards the lower lever cam assembly 40. Securing the first end 71 (i.e., single end) of power cable 70 to the anchor 130 and within the groove 131 puts the power cable 70 in a take-up position. Specifically, as the lever cam 100 rotates when bow 10 is drawn, the anchor 130 rotates with the lever cam 100 and causes the first end 71 of power cable 70 to also rotate. In some embodiments, this causes a larger section of power cable 70 to be taken up within groove 131.

The lever cam 100 further includes a bowstring anchor 135 located on the forward side of the elongated lever arm 102 of the lever cam 100. The bowstring anchor 135 secures one end of the bowstring 50 thereto. The first end 51 of the bowstring 50 is attached to the bowstring anchor 135 and extends upward and over the elongated lever arm 102 of the lever cam 100 via a bowstring groove 136. Similar to the power cable groove 131, the bowstring groove 136 aligns the bowstring 50 within groove 136 as it extends from the lever cam 100 of the upper lever cam assembly 35 towards the lower lever cam assembly 40. In this embodiment, the bowstring groove 136 extends along the periphery of the elongated lever arm 102. This prevents the bowstring 50 from slipping off of the lever cam 100. Said differently, the bowstring 50 is routed from the bowstring anchor 135, over the end of elongated lever arm 102 and within groove 136, down towards lower lever cam assembly 40.

Figure 10:
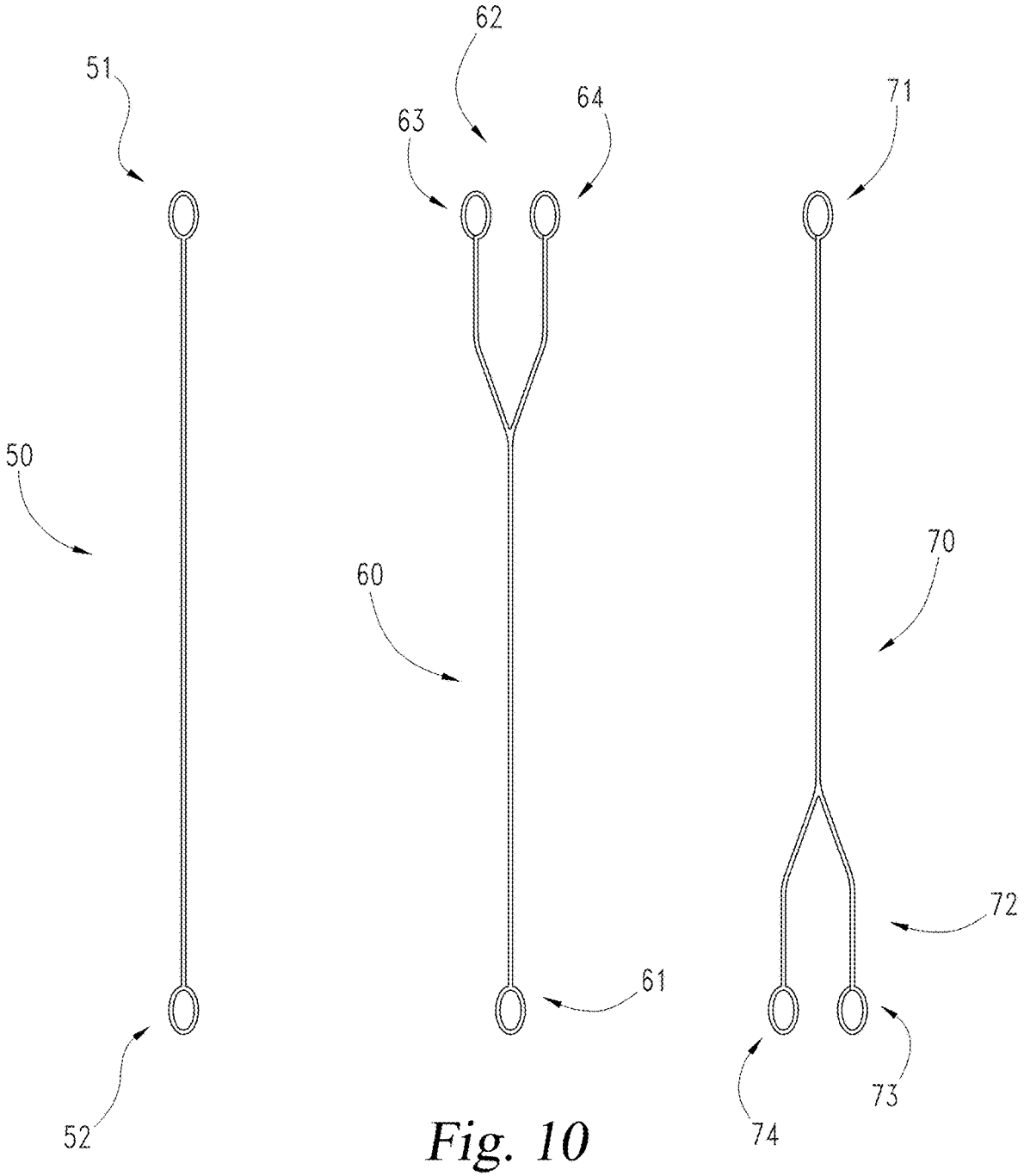
FIG. 10 is a schematic view of an exemplar bowstring and exemplar power cables used in conjunction with bows of the present disclosure.

As shown in FIGS. 4-5, the second end 62 of power cable 60 is secured to anchors 125 via loops 63, 64 (see FIG. 10). The upper offset axle 110 extends a sufficient lateral distance from lever cam 100 and limbs 22, 23 to ensure that the second end 62 of power cable 60 is not interfered with by the limbs 22, 23. Further, the first end 61 on the single end of power cable 60 is attached to anchor 230 on base 201 of the lower lever cam 200. Correspondingly, the first end 71 on the single end of power cable 70 is attached to anchor 130 on base 101 of the lever cam 100. As the power cable 70 is routed along base 101 of lever cam 100, a portion of the power cable 70 is aligned within groove 131.

Figure 6:
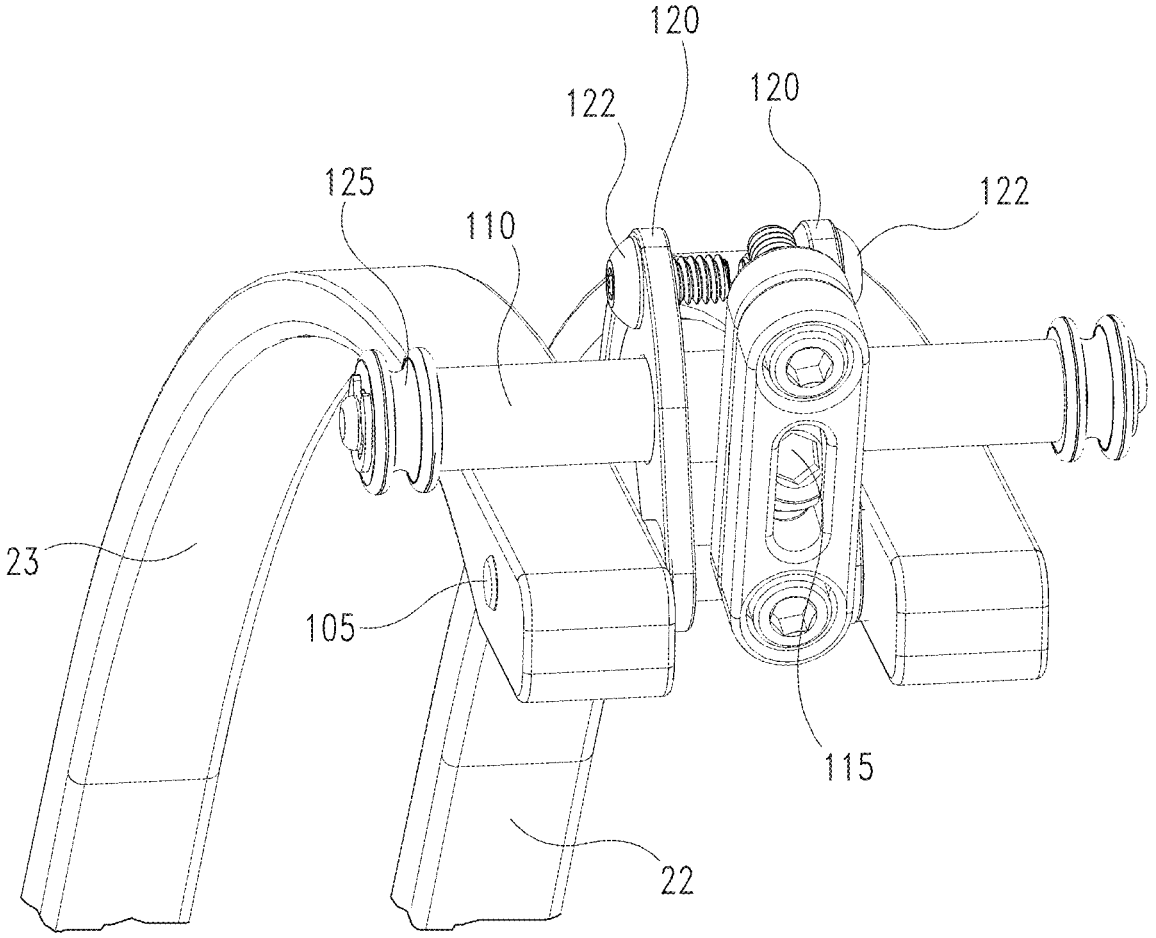
FIG. 6 is a view of the upper lever cam assembly of FIG. 5 with the lever cam removed for ease of illustration.

FIG. 6 is the same as FIG. 5, but with the lever cam 100 removed for ease of illustration. The lever cam 100 sits between the link arms 120, which are secured to the lever cam 100 via set screws 122. Further, the lever axle 105 extends through bores located on link arms 120. In this way, the portion of the link arms 120 attached to the lever axle 105 act as a pivot point, while the guides 121 rotate relative thereto, mirroring the movement of lever cam 100. In this embodiment, the lever axle 105 also extends through the lever cam 100. In this embodiment, the lever axle 105 is a pin.

Figure 7:
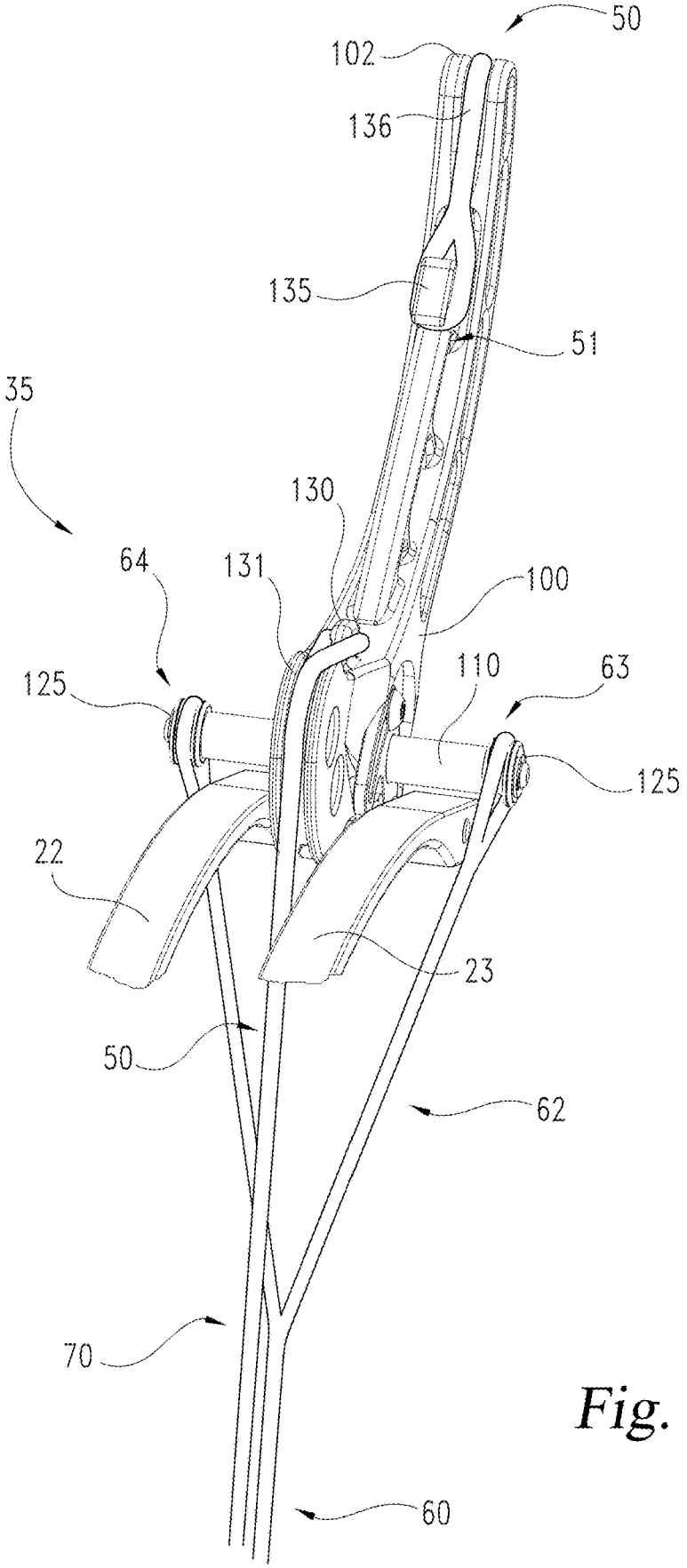
FIG. 7 is a front perspective view of the upper lever cam assembly of FIG. 4.

FIG. 7 illustrates a front, perspective view of the upper lever cam assembly 35. As shown, the base 101 of the lever cam 100 includes a power cable groove 131. In this embodiment, the power cable groove 131 extends along the periphery of base 101. In other embodiments, power cable grooves of various lengths may be used. Regardless of the embodiment, however, attachment of first end 71 of the power cable 70 to the anchor 130 and subsequent placement of power cable 70 within power cable groove 131 positions the power cable 70 such that it extends down towards the lower lever cam 200 between the limbs 22, 23.

Figure 8:
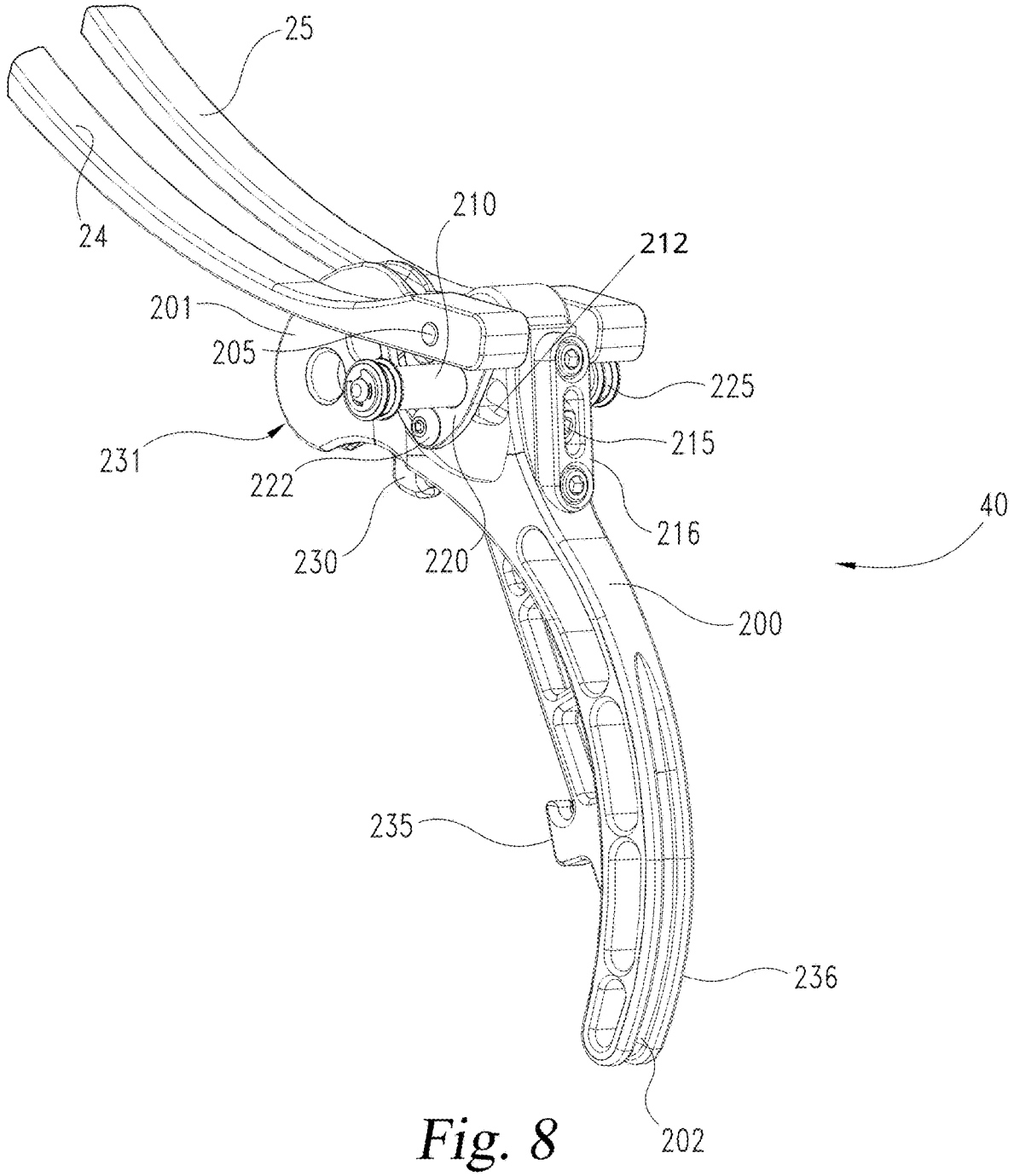
FIG. 8 is a side perspective vie of the lower limb lever assembly of the bow shown in FIG. 2.
Figure 9:
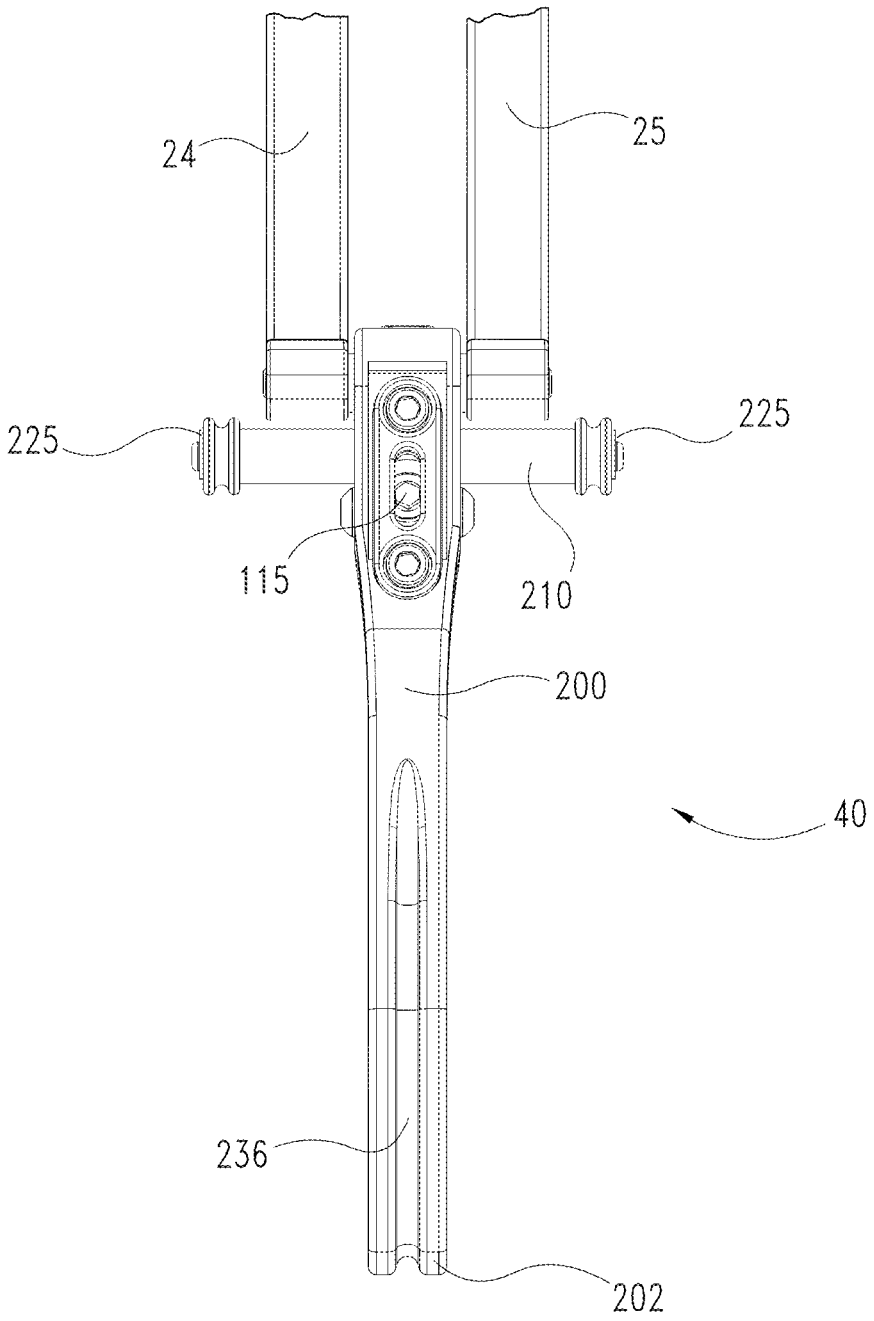
FIG. 9 is a rear view of the lower lever cam assembly of FIG. 8.

FIGS. 8 and 9 depict the lower lever cam assembly 40 attached between the lower right limb 24 and the lower left limb 25. The lower lever cam assembly 40 is a mirror of the upper lever cam assembly 35 discussed above, with the corresponding opposite ends of bowstring 50 and power cables 60, 70 being attached correspondingly. The primary difference is that the lower elongated lever arm 202 of the lever cam 200 of lower lever cam assembly 40 extends downward, whereas the elongated lever arm 102 of lever cam 100 extends upward, as shown in FIG. 2. The lower elongated lever arm 202 includes a rearward side (i.e., towards to archer) and a forward side (i.e., towards the riser 15). The lever cams 100, 200 function in the same manner. The lower lever cam assembly 40 further includes lever axle 205, which pivotally couples the lever cam 200 between the left and right lower limbs 24, 25. The lever cam 200 rotates about lever axle 205. In this embodiment, the lever cam assembly 405 includes offset axle portions 210 that comprise a single piece that extends through the lever cam 200. Offset axle 210 is parallel to yet spaced apart from lever axle 205. The lower offset axle portions 210 extend through a slot 212 in the lower lever cam base 201. The lever cam assembly 40 further includes lower adjustment screw 215 coupled to offset axle 210 and secured to lever cam 200 via screw plate 216. In this embodiment, the adjustment screw 215 is a worm gear threaded perpendicularly within offset axle 210. In other embodiments, other mechanisms may be used. Further, the adjustment of the cams 100, 200 via upper and lower adjustment screws 115, 215 should be set to a matched position before use of bow 10. With respect to this embodiment, the matched position means that the adjustment screws 115, 215 of the lever cams 100, 200 are rotated such that the lever cams 100, 200 have the same degree of rotation relative to the limbs. The matched positions of upper lever cam 100 and lower lever cam 200 allow the lever cams to be synchronized during use of bow 10. This ensures a level draw and release of the bowstring 50 during use of bow 10. To that end, in some embodiments, the offset link arms 120, 220 may include notches or numbers to indicate the relative rotational positions of lever cams 100, 200.

FIG. 10 is a schematic diagram of a bowstring 50, and two power cables 60 and 70. As shown the bowstring 50 includes two single-eyed ends, first end 51 and second end 52. Power cable 60 includes a first end 61 and second end 62, where the second end 62 includes anchor points 63 and 64. Similarly, power cable 70 includes a first end 71 and a second end 72, where the second end 72 includes anchor points 73 and 74. The lengths of the cables shown in FIG. 10 are illustrative and not intended to be to scale. In this embodiment, the first end 51 of bowstring 50 is attached to the upper lever cam assembly 35 while the second end 52 is attached to the lower lever cam assembly 40. Further, the second end 62 of power cable 60 is attached to the upper lever cam assembly 35 by attaching the anchor points 63, 64 to opposing ends of the offset axle 110 of upper lever cam assembly 35, while the first end 61 of power cable 60 is attached to lower lever cam assembly 40. At the same time, the first end 71 of power cable 70 is attached to upper lever cam assembly 35, while the second end 72 of power cable 70 is attached to the lower lever cam assembly 40 by attaching the anchor points 73, 74 to opposing ends of the lower offset axle portions 210 of lower lever cam assembly 40. In some embodiments, the power cables may cross to form an "x" pattern by crossing at cable guide 45 of bow 10.

Figure 11:
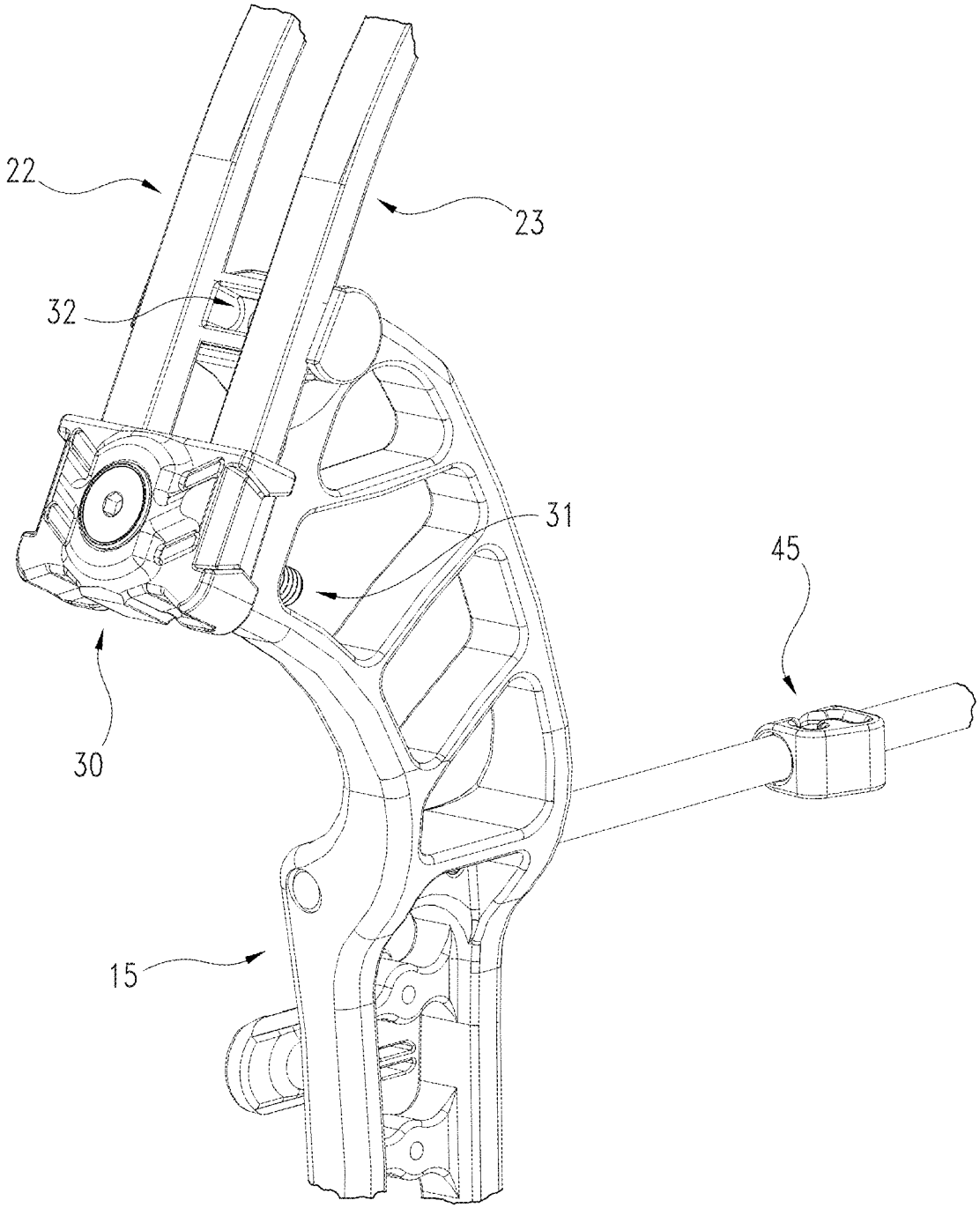
FIG. 11 is a zoomed in, perspective view of the top portion of the riser of the bow depicted in FIG. 2.

FIG. 11 illustrates a zoomed in view of the connection point of upper left limb 22 and upper right limb 23 to riser 15 via limb pocket 30. As shown, the ends of the limbs 22, 23 are insertable into the limb pocket 30 and the limbs 22, 23 and limb pocket 30 are attached to riser 15 via fastener 31. Additionally, in this embodiment, the riser 15 includes a spacer 32 to precisely space and separate the upper left limb 22 from the upper right limb 23. In this embodiment, the lower right limb 24 and lower left limb 25 are attached to the opposing end of riser 15 in the same way, i.e., by attachment to the riser 15 by limb pocket 30 and fastener 31.

Figure 12:
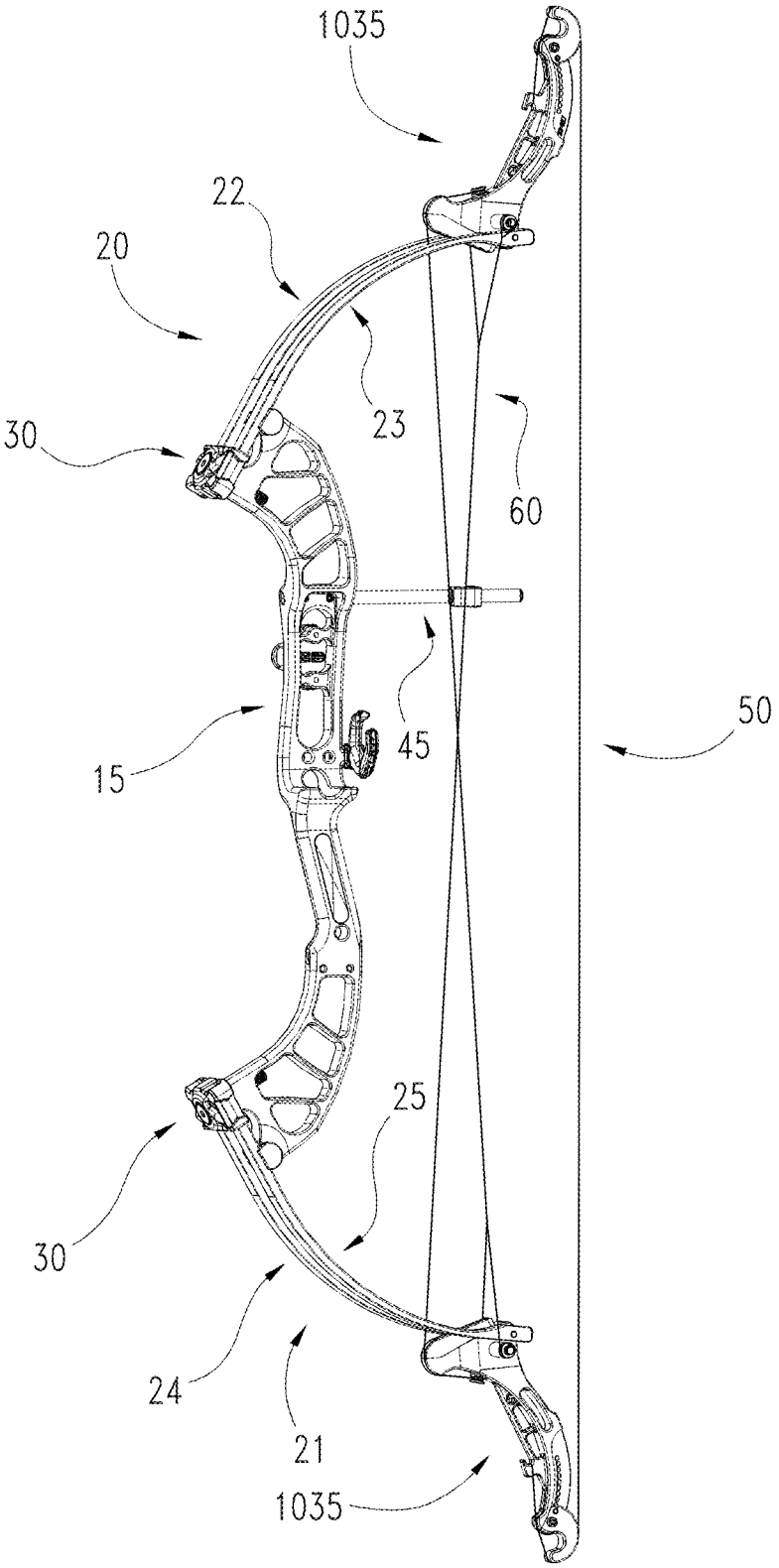
FIG. 12 is a perspective view of another embodiment of a compound lever bow of the present disclosure.

FIG. 12 depicts another embodiment of an archery bow 1000 of the present disclosure. The bow 1000 is the same bow as bow 10, with the exception of the upper lever cam assembly 1035 and the lower lever cam assembly 1040. Comparably, the lever assemblies 1035, 1040 are rotatably secured between the respective upper limbs 22, 23 and lower limbs 24, 25.

Figure 13:
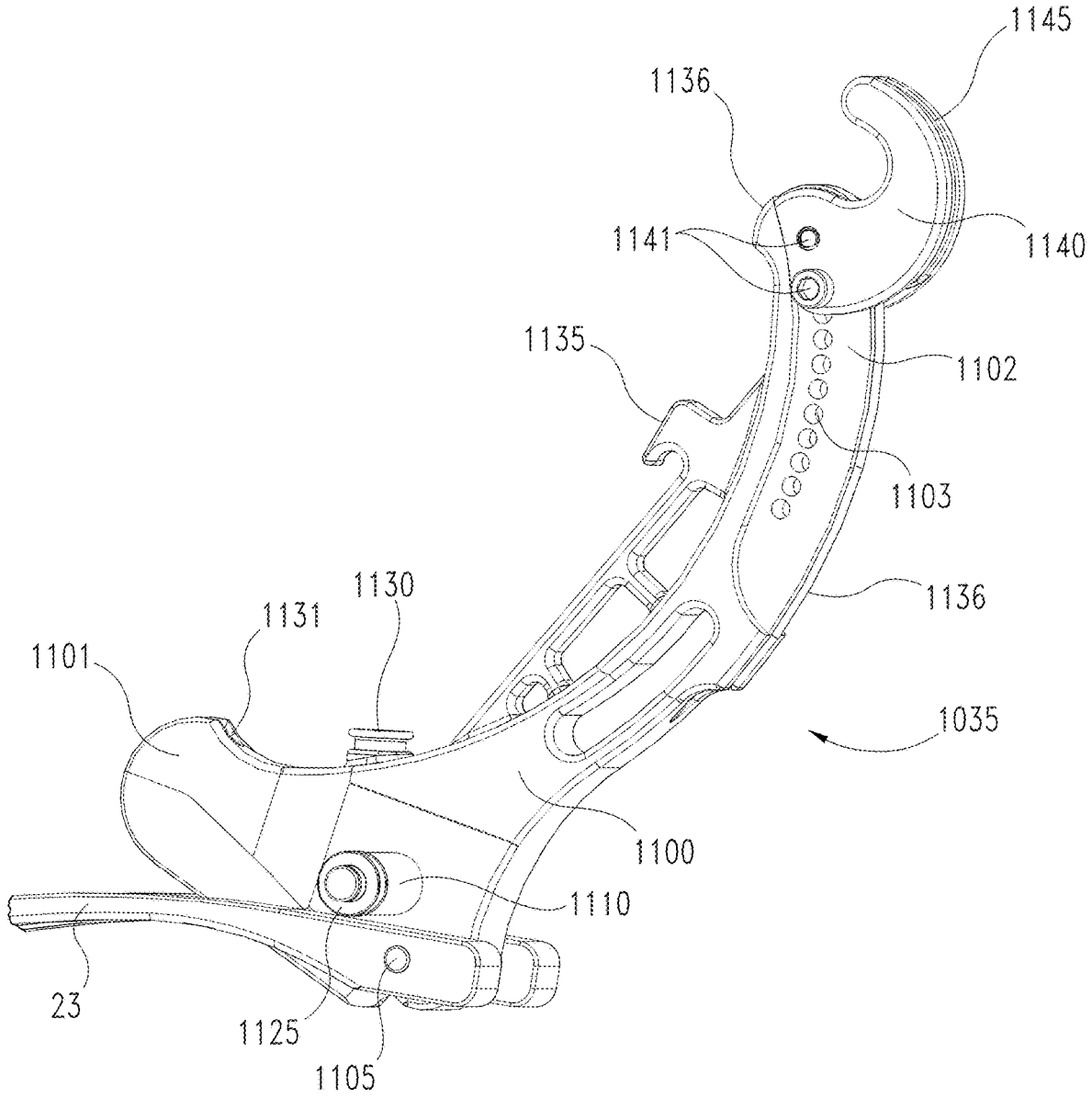
FIG. 13 is a side perspective view of the upper lever cam assembly of the bow shown in FIG. 12.

FIG. 13 is a side view of the upper lever cam assembly 1035 of bow 1000. In this embodiment, the forward side of elongated lever arm 1102 includes a bowstring anchor 1135. The elongated lever arm 1102 also includes a bowstring groove 1136, similar to the bowstring anchor 135 and bowstring groove 136 of upper lever cam assembly 35. The first end 51 of bowstring 50 is anchored to the bowstring anchor 1135 and sits within and is aligned by bowstring groove 1136. The elongated lever arm 1102 of the lever cam 1100 further includes a series of bores 1103. Each of the series of bores 1103 extends through the width of the elongated lever arm 1102. In this embodiment, the series of bores 1103 are illustrated as a series of eleven (11) bores. In other embodiments, the series of bores 1103 includes at least two or more bores.

In this embodiment, the upper lever cam assembly 1035 includes an adjustable bowstring module 1140. The bowstring module 1140 alters the draw length of bowstring 50 by altering the manner in which the bowstring 50 lies and aligns on lever cam 1100. Said differently, the adjustable bowstring module 1140 re-routes the path of the bowstring 50 by effectively extending the length and/or width of the elongated lever arm 1102. The bowstring module 1140 includes fastening locations 1141. The fastening locations 1141 are configured to align with and secure to a pair of bores 1103. Securing the fastening locations 1141 of bowstring module 1140 to different pairs of bores 1103 in different selected locations secures the bowstring module 1140 to the elongated lever arm 1102 of lever cam 1100 in different positions. The different positions alter the draw length of bowstring 50 to different lengths.

The bowstring module includes module groove 1145. The module groove 1145 is configured to receive a portion near first end 51 of bowstring 50 within the groove 1145 and align bowstring 50 as it extends towards lower lever cam assembly 1040. In some embodiments, a portion of bowstring 50 is still received within a portion of bowstring groove 1136 on the forward side of the elongated lever arm 1102. With bowstring module 1140 attached to the elongated lever arm 1102, the bowstring 50 is still secured by the first end 51 to bowstring anchor 1135. The bowstring is routed up and within groove 1136, then up and over adjustable bowstring module 1140 within groove 1145, and down towards lower lever cam assembly 1040 and the bowstring attached in a similar manner around bowstring module 1240 and anchored on the second end 52 of bowstring 50 to bowstring anchor 1235 of lever cam 1200.

Bowstring module 1140 alters the draw length of bowstring 50 of bow 1000. As illustrated, the bowstring module is attached to the bores 1103 of lever cam 1100 furthest from limbs 22, 23. This position of bowstring module 1140 represents the "shortest" draw length configuration of bowstring module 1140. Specifically, as bowstring module 1140 is secured to the elongated lever arm 1102 of the lever cam 1100 further from limbs 22, 23, the bowstring 50 is placed in a position closer to full draw, thus decreasing or "shortening" the draw length of bowstring 50. When the bowstring module 1140 is secured to the elongated lever arm 1102 of lever cam 1100 closer to limbs 22, 23, the draw length is increased or "lengthened". Effectively, the lower that adjustable bowstring module 1140 is placed, the less additional distance bowstring 50 is routed. Thus, the bowstring 50 is not as close to as full draw position as that illustrated in FIG. 13.

Figure 14:
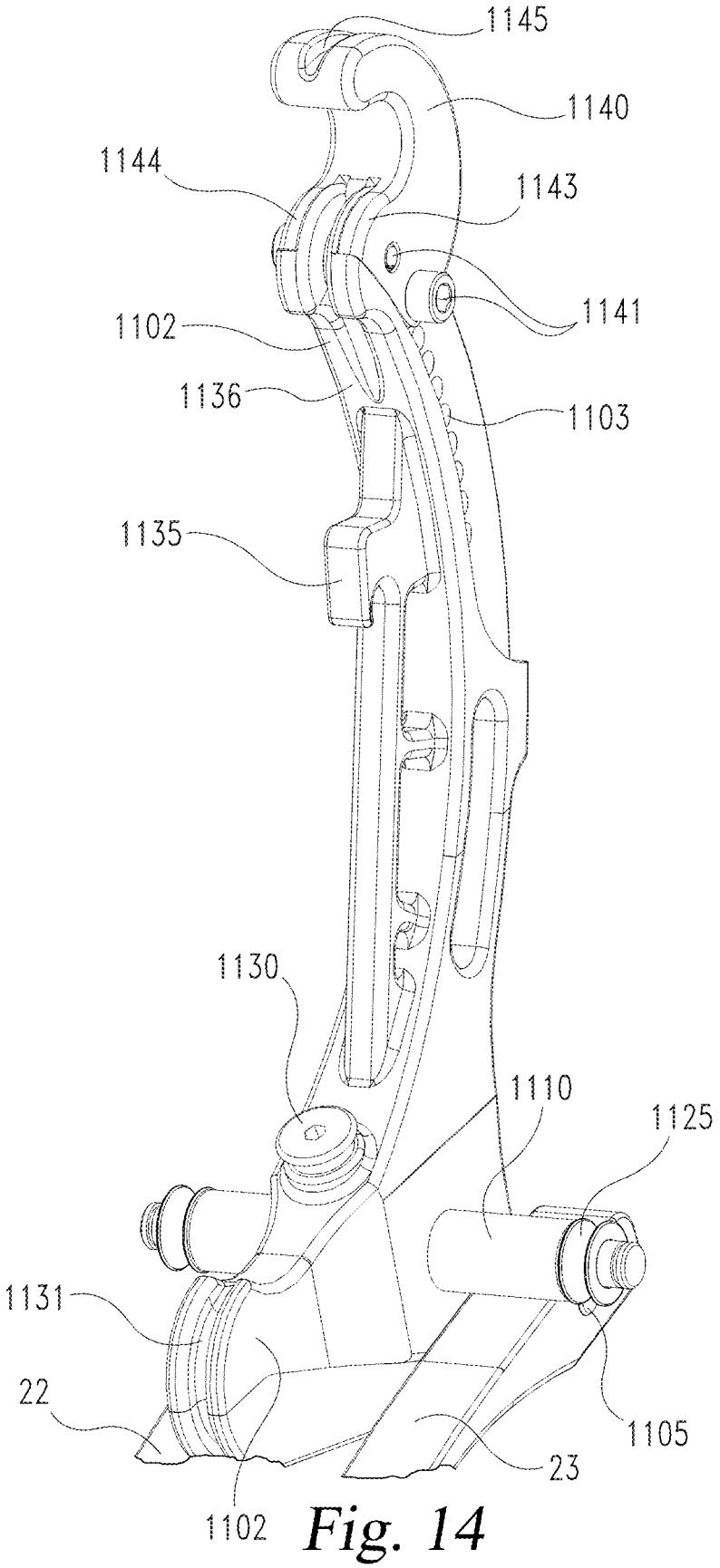
FIG. 14 is a front perspective view of the upper limb lever assembly of FIG. 13.

FIG. 14 illustrates a front perspective view of the upper lever cam assembly 1035 of bow 1000. Similar to the upper lever cam assembly 35 of bow 10, when the first end 71 of power cable 70 is attached to the power cable anchor 1130, the power cable is secured and aligned within power cable groove 1131. The power cable 70 then extends between the upper left limb 22 and the upper right limb 23, towards the lower lever cam assembly 1040. In this embodiment, the second end 62 of power cable 60 is attached to the power cable anchors 1125 located at opposing ends of the offset axle portions 1110 of upper lever cam assembly 1035 by attaching anchors 63, 64 thereto. In this embodiment, upper offset axle portions 1110 comprise two pieces extending from opposing sides of the upper lever cam 1100. Further, in this embodiment, the bowstring 50 is attached to the bowstring anchor 1135, secured within a portion of bowstring groove 1136, and further secured within module groove 1145. In other embodiments, the bowstring 50 is not aligned with any part of bowstring groove 1136 when bowstring module 1140 is attached to the elongated lever arm 1102 of lever cam 1100.

Figure 15:
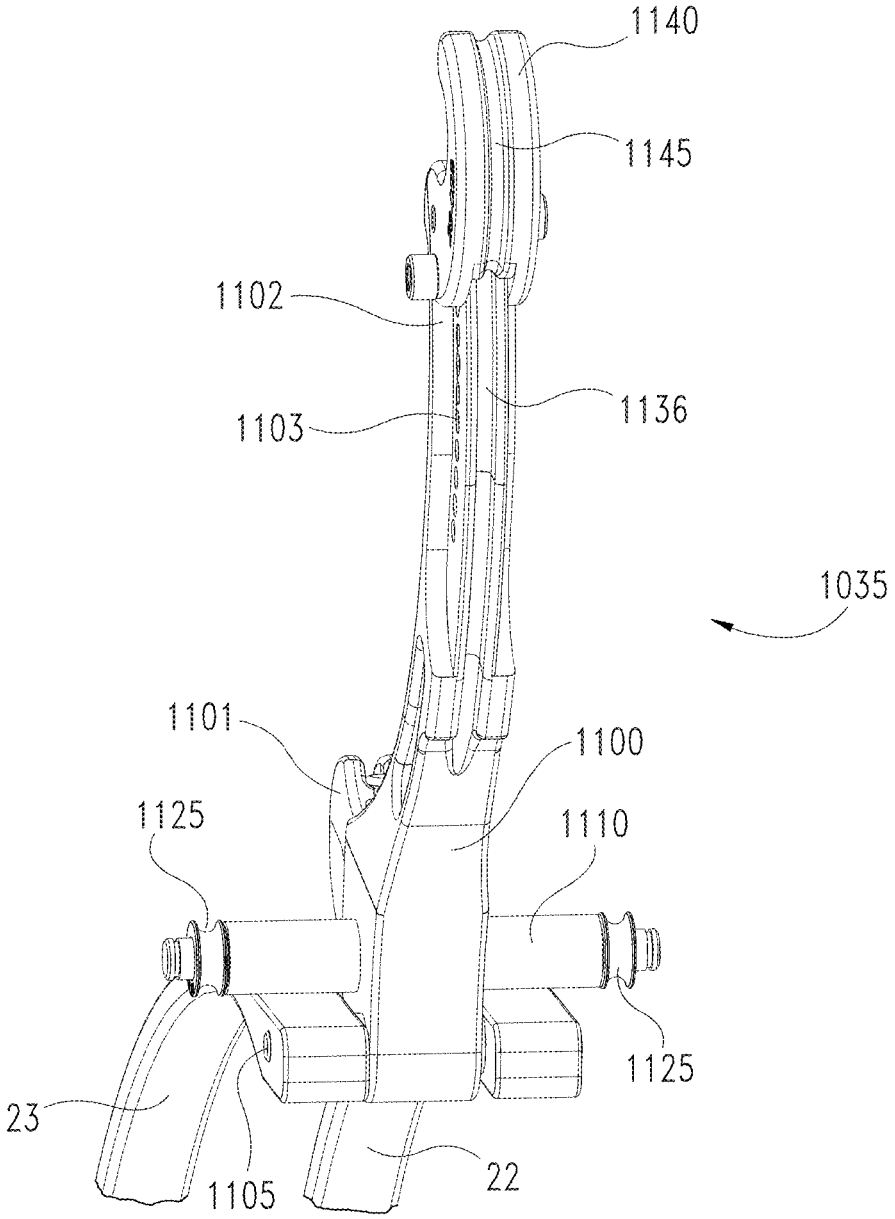
FIG. 15 is a rear perspective view of the upper limb lever assembly of FIG. 13.

FIG. 15 is a rear perspective view of the upper lever cam assembly 1035 of FIG. 14. The adjustable bowstring module 1140 offsets the routing of bowstring 50. As such, the bowstring 50 will not be received in the portion of bowstring groove 1136 visible in FIG. 15.

Figure 16:
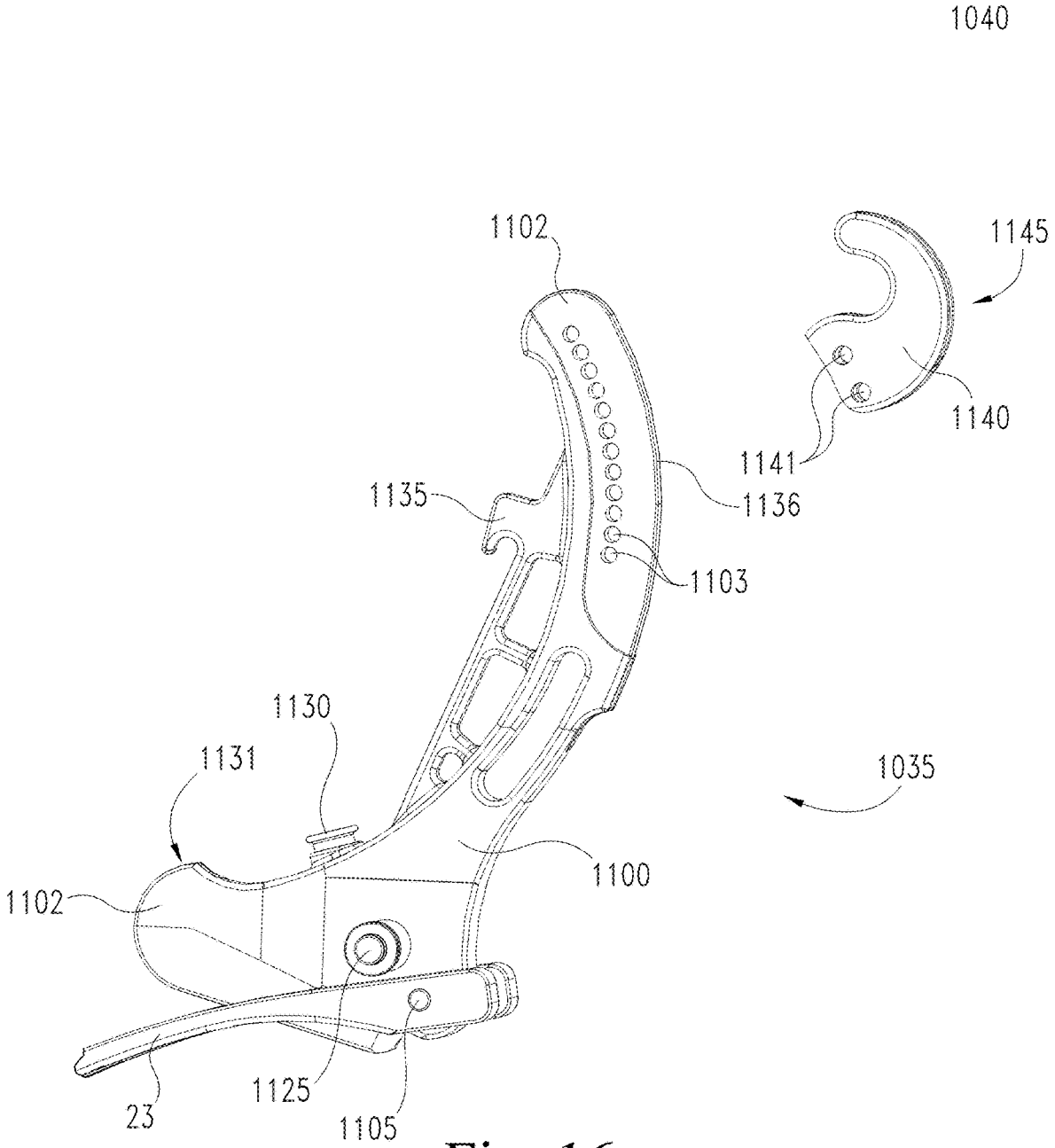
FIG. 16 is side view of the upper lever cam assembly of FIG. 13 with the bowstring module removed.

FIG. 16 depicts the bowstring module 1140 detached from the elongated lever arm 1102 of the lever cam 1100 of the upper lever cam assembly 1035. In one arrangement, a user may modify the upper lever cam assembly 1035 to remove the bowstring module 1140 and attach the bowstring 50 to the lever cam 1100 without any module attached.

Figure 17:
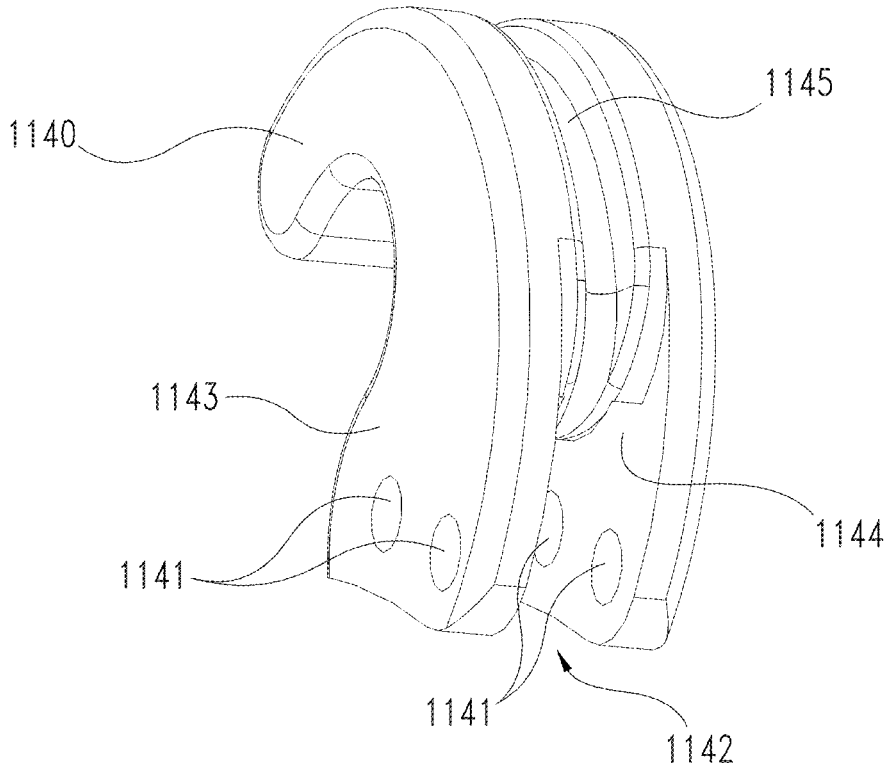
FIG. 17 is a rear perspective view of the bowstring module of the upper lever cam assembly of FIG. 13.

FIG. 17 is a rear perspective view of the bowstring module 1140. The bowstring module 1140 generally has a hook shape. The bowstring module 1140 comprises two sidewalls 1143, 1144 that define the bowstring groove 1145 and a slot 1142. The slot 1142 receives a portion of the elongated lever arm 1102 of the lever cam 1100 between sidewall 1143 and sidewall 1144. When the slot 1142 of bowstring module 1140 is inserted over the elongated lever arm 1102, the fastener bores 1141 are aligned with at least two of the series of bores 1103. In some embodiments, the bowstring module 1140 is a single, molded piece of material. In other embodiments, the bowstring module 1140 may be multiple components secured to each another.

Figure 18:
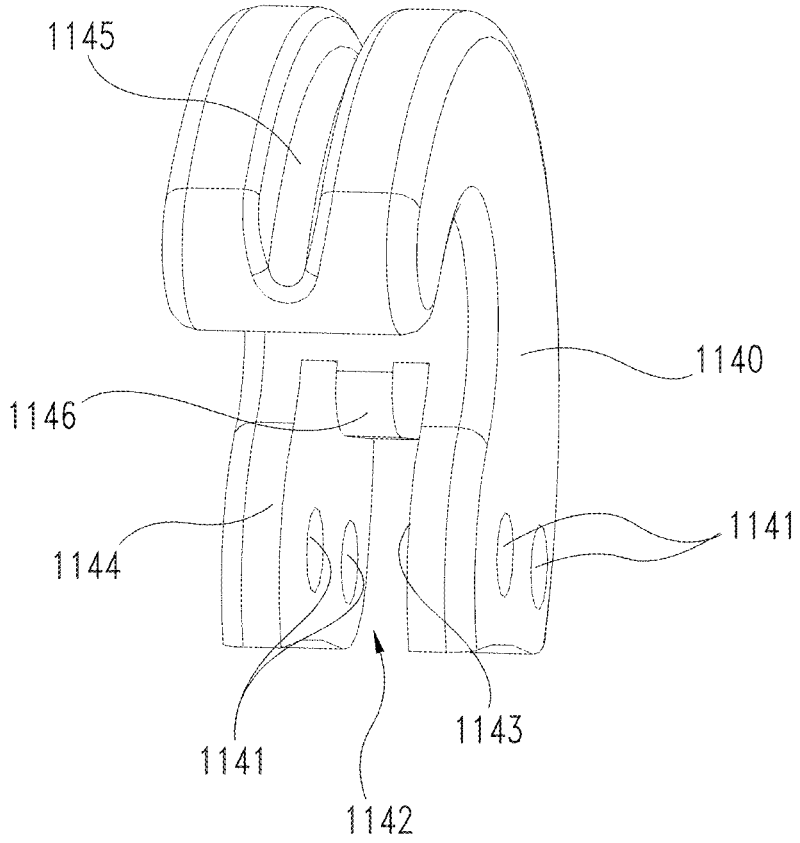
FIG. 18 is a front perspective view of the bowstring module of FIG. 17.

FIG. 18 is a front perspective view of the bowstring module 1140. In some embodiments, the bowstring module 1140 includes a groove guide 1146. The groove guide 1146 is insertable into the bowstring groove 1136 of lever cam 1100. During attachment of bowstring module 1140, the groove guide 1146 is securely inserted within bowstring groove 1136. Groove guide 1146 properly aligns bowstring module 1140 relative to the lever cam 1100. In some embodiments, the groove guide 1146 is made of polyurethane, rubber, or another rubber-like material to create friction between groove guide 1146 and bowstring groove 1136.

Figure 19:
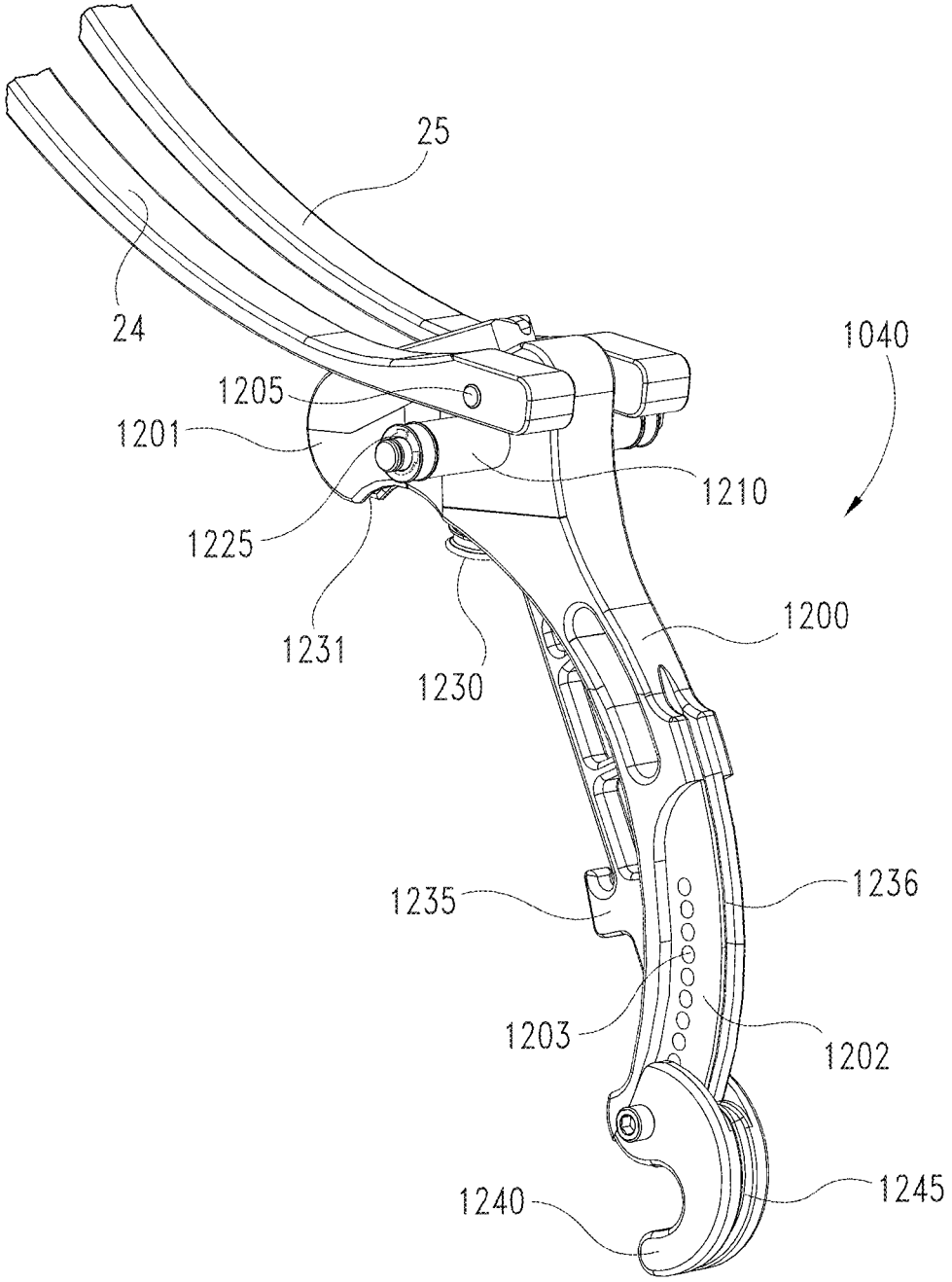
FIG. 19 is a side perspective view of the lower limb lever assembly of the bow of FIG. 12.
Figure 20:
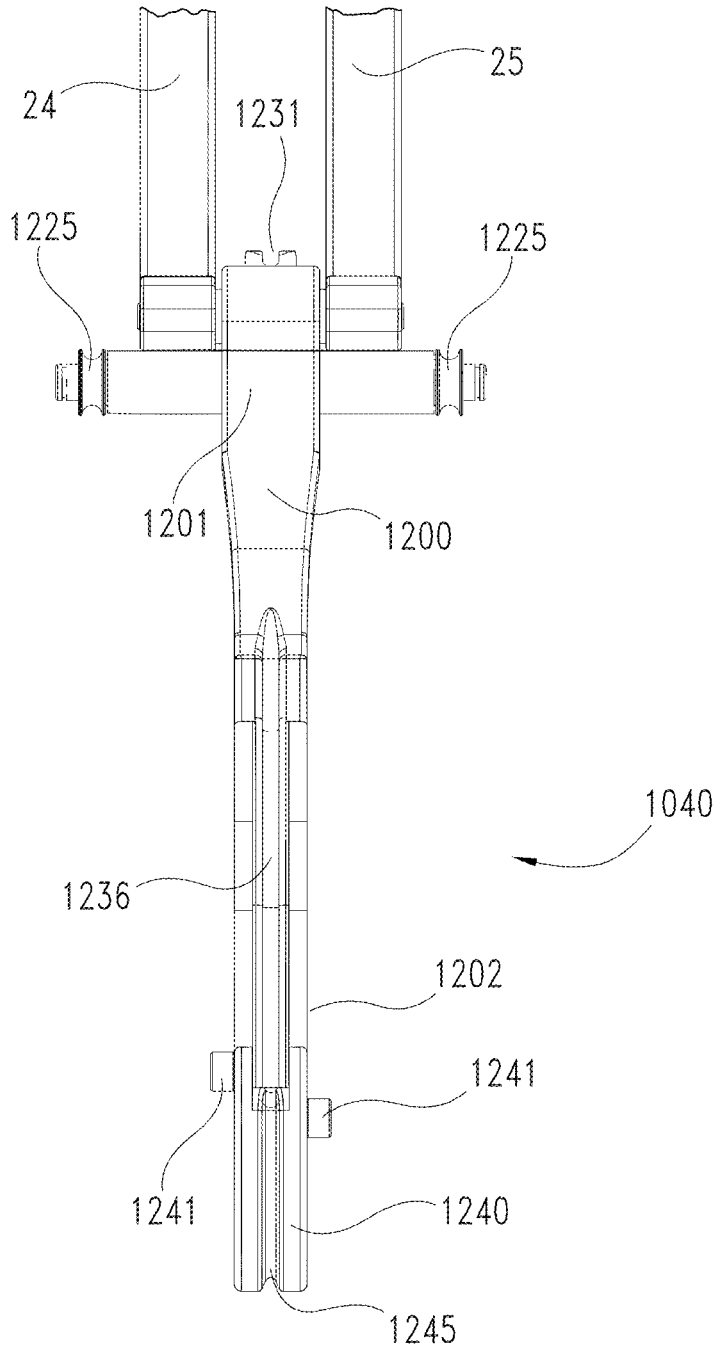
FIG. 20 is a rear view of the lower lever cam assembly shown in FIG. 19.

FIGS. 19 and 20 depict the lower lever cam assembly 1040 attached between the lower right limb 24 and the lower left limb 25 of bow 1000. The lower lever cam assembly 1040 is a mirror of the upper lever cam assembly 1035 discussed above, with the corresponding ends of bowstring 50 and power cables 60, 70 being attached correspondingly. The primary difference is that the elongated lever arm 1202 of the lever cam 1200 of lower lever cam assembly 1040 extends downward, whereas the elongated lever arm 1102 of lever cam 1100 extends upward, as shown in FIG. 12. The lever cams 1100, 1200 function in the same manner. Further, positioning of the bowstring modules 1140, 1240 should be set to a matched position before use of bow 1000. With respect to this embodiment, the matched position means that the bowstring modules 1140, 1240 are attached to matched sets of bores 1103, 1203 on upper elongated lever arm 1102 and lower elongated lever arm 1202. For example, if the bowstring module 1140 is attached to a pair of bores 1103 furthest from base 1101 (i.e., the most upward pair of bores) of lever cam 1100, then the bowstring module 1240 is attached to a pair of bores 1203 furthest from base 1201 (i.e., the most downward pair of bores) of lever cam 1200. The matched positions of the bowstring modules 1140, 1240 allow the lever cams 1100, 1200 to be synchronized during use of bow 1000. This ensures level draw and release of the bowstring 50 during use of bow 1000.

It is contemplated that the upper lever cam assembly 35 and lower lever cam assembly 40 may include the bowstring modules 1140, 1240 of upper lever cam assembly 1035 and lower lever cam assembly 1040, respectively, including the series of bores 1103, 1203 located on the elongated lever arms 1102, 1202 of lever cams 1100, 1200. Alternatively, it is further contemplated that upper lever cam assembly 1035 and lower lever cam assembly 1040 of bow 1000 may include the adjustment screws 115, 215 of upper lever cam assembly 35 and lower lever cam assembly 40 of bow 10, respectively. Stated differently, the adjustment mechanisms described herein may be used alone or in conjunction to provide various mechanisms to easily alter the draw length of a bow. It is further contemplated that the adjustment mechanisms, while shown in conjunction with the lever cams of the present disclosure, may also be implemented with other types of bows. For example, the adjustment mechanisms may be used in conjunction with compound or lever bows. Specifically, the adjustment screw embodiment and/or the adjustable bowstring module embodiment disclosed herein may be used in conjunction with the rotational members of a compound bow or a lever bow; namely the cams and levers, respectively.

While the disclosure has been illustrated and described in detail in the drawings and foregoing description, the same is to be considered as illustrative and not restrictive in character, it being understood that only the preferred embodiment has been shown and described and that all changes, equivalents, and modifications that come within the spirit of the disclosures defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. An archery bow, comprising:

a riser configured as a handle of the archery bow;

an upper limb attached to an upper portion of the riser, wherein the upper limb comprises an upper left limb and an upper right limb;

a lower limb attached to a lower portion of the riser, wherein the lower limb comprises a lower left limb and a lower right limb;

an upper lever cam assembly including an upper lever cam with a base and an elongated lever arm extending upward from the base and a first lever axle, wherein the upper lever cam is rotatably attached between the upper left and upper right limbs via the first lever axle;

a lower lever cam assembly including a lower lever cam with a base and an elongated lever arm extending downward form the base and a second lever axle, wherein the lower lever cam is rotatably attached between the lower left and lower right limbs via the second lever axle;

a first power cable with a first end anchored to the base of the upper lever cam in a take-up position and a second end;

a second power cable with a first end anchored to the base of the lower lever cam in a take-up position and a second end; and a bowstring with a first end extending up and over a rearward side of the elongated lever arm of the upper lever cam and anchored to the upper lever cam, and a second end extending down and under a rearward side of the elongated lever arm of the lower lever cam and anchored to the lower lever cam;

wherein the upper lever cam assembly includes upper offset axle portions extending from the upper lever cam base parallel to the first lever axle, wherein the second end of the second power cable includes a pair of ends anchored to the upper offset axle portions;

wherein the lower lever cam assembly includes lower offset axle portions extending from the lower lever cam base parallel to the second lever axle, wherein the second end of the first power cable includes a pair of ends anchored to the lower offset axle portions;

wherein the upper offset axle portions are a single piece forming an upper offset axle extending through the upper lever cam, and wherein the lower offset axle portions are a single piece forming a lower offset axle extending through the lower lever cam;

an upper adjustment screw engaged between the upper lever cam base and the upper offset axle, wherein the upper offset axle extends through a slot in the upper lever cam base, and wherein rotation of the upper adjustment screw alters the position of the upper offset axle through the upper lever cam relative to the upper lever axle; and a lower adjustment screw engaged between the lower lever cam base and the lower offset axle, wherein the lower offset axle extends through a slot in the lower lever cam base, and wherein rotation of the lower adjustment screw alters the position of the lower offset axle through the lower lever cam relative to the lower lever axle.

2. The archery bow of claim 1, wherein the upper offset axle portions are a pair of pieces extending from opposing sides of the upper lever cam, and wherein the lower offset axle portions are a pair of pieces extending from opposing sides of the lower lever cam.

3. The archery bow of claim 1, wherein rotating the upper adjustment screw rotates the upper lever cam relative to the limbs of the bow.

4. The archery bow of claim 3, wherein the upper adjustment screw is rotatable to specific positions to allow an archer to choose a draw length of the bow.

5. The archery bow of claim 3, wherein the upper adjustment screw comprises a worm gear perpendicularly extending through the upper offset axle.

6. The archery bow of claim 4, wherein the upper adjustment screw and the lower adjustment screw are rotated to a matched position such that the upper lever cam assembly and the lower lever cam assembly are synchronized during draw and release of the bow.

7. The archery bow of claim 1, wherein the second ends of the first power cable and the second power cable are attached to power cable anchors at opposing ends of the upper offset axle and the lower offset axle.

8. An archery bow, comprising:

a riser configured as a handle of the archery bow;

an upper limb attached to an upper portion of the riser, wherein the upper limb comprises an upper left limb and an upper right limb;

a lower limb attached to a lower portion of the riser, wherein the lower limb comprises a lower left limb and a lower right limb;

an upper lever cam assembly including an upper lever cam with a base and an upper elongated lever arm extending upward from the base and a first lever axle, wherein the upper lever cam is rotatably attached between the upper left and upper right limbs via the first lever axle;

a lower lever cam assembly including a lower lever cam with a base and a lower elongated lever arm extending downward form the base and a second lever axle, wherein the lower lever cam is rotatably attached between the lower left and lower right limbs via the second lever axle;

a first power cable with a first end anchored to the base of the upper lever cam in a take-up position and a second end anchored to the lower lever cam assembly;

a second power cable with a first end anchored to the base of the lower lever cam in a take-up position and a second end anchored to the upper lever cam assembly; and a bowstring with a first end extending up and over a rearward side of the elongated lever arm of the upper lever cam and anchored to the upper lever cam, and a second end extending down and under a rearward side of the elongated lever arm of the lower lever cam and anchored to the lower lever cam; and a pair of bowstring modules respectively coupled to the upper elongated lever arm and the lower elongated lever arm to receive and route the bowstring.

9. The archery bow of claim 8, wherein the upper elongated lever arm and the lower elongated lever arm each include a series of bores to couple the bowstring modules to the elongated lever arms.

10. The archery bow of claim 9, wherein the bowstring modules are attachable to different bores of the series of bores to define different draw lengths of the archery bow.

11. The archery bow of claim 10, wherein the bowstring modules are coupled to matched sets of bores on the upper elongated lever arm and the lower elongated lever arm to synchronize the lever cams.

12. The archery bow of claim 8, wherein the bowstring modules each include a groove guide extending from the module engaging the respective upper elongated lever arm and the lower elongated lever arm to align the bowstring module on the respective upper lever cam and lower lever cam.

* * * * *